United States Patent [19]

Catan et al.

[11] Patent Number: 5,044,259

[45] Date of Patent: Sep. 3, 1991

[54] AIR DIFFUSION SYSTEM CAPABLE OF LIMITED AREA CONTROL AND ADAPTED FOR SUPPLYING MAKE-UP AIR TO AN ENCLOSURE

[75] Inventors: Robert S. Catan, Greenlawn; Mark Catan, Mt. Sinai, both of N.Y.

[73] Assignee: Dynaforce Corporation, Old Bethpage, N.Y.

[21] Appl. No.: 425,426

[22] Filed: Oct. 23, 1989

[51] Int. Cl.[5] ..... F24F 7/06

[52] U.S. Cl. ..... 98/40.19; 98/40.18

[58] Field of Search ..... 98/40.1, 40.11, 40.18, 98/40.19; 236/49.3, 51

[56] References Cited

U.S. PATENT DOCUMENTS

| | | | |
|---|---|---|---|
| 2,000,112 | 5/1935 | Wheller | 98/40.19 X |
| 2,117,529 | 5/1938 | Wile et al. | 98/40.25 X |
| 3,404,618 | 10/1968 | Jacobs | 98/40.19 X |
| 4,382,401 | 5/1983 | Simmler | 98/40.19 |
| 4,807,523 | 2/1989 | Radtke et al. | 98/2.04 X |

FOREIGN PATENT DOCUMENTS

| | | | |
|---|---|---|---|
| 985622 | 12/1982 | U.S.S.R. | 98/40.18 |

*Primary Examiner*—Harold Joyce
*Attorney, Agent, or Firm*—Alan K. Roberts

[57] ABSTRACT

An air distribution system is provided which includes a source of intake air leading into a conduit through which the air is forced by a fan or the like. Provision can be made for heating the air. The conduit is a rigid structure provided with a plurality of openings. In association with these openings, there are provided control devices of various types. One type of control device which is employed is used to change the direction of flow of the air upon the exiting of this air from the conduit. In another type of control device the diffusion of the air is controlled upon the exiting of the same from the conduit. Another type of device which is employed is an internal device designed to intercept at least part of the flow of air within the conduit and to divert the same through the associated opening. Some of these devices may be controlled by a signal generated at a remote signal source under the control of a sensor which is located in the area or enclosure in which air is to be distributed. The conduit may be supplied in sections and these sections may be telescopically engaged. The air supplied through the conduit may be heated or not depending upon the function to be performed.

2 Claims, 3 Drawing Sheets

AIR DIFFUSION SYSTEM CAPABLE OF LIMITED AREA CONTROL AND ADAPTED FOR SUPPLYING MAKE-UP AIR TO AN ENCLOSURE

FIELD OF INVENTION

This invention relates to air supply devices and more particularly to air supply devices for supplying make-up and recirculated air and designed to eliminate negative pressure, stabilize building temperature and reduce heating costs. The invention relates furthermore to devices of the foregoing type which are capable of supplying air, both heated and otherwise, to limited areas or zones.

BACKGROUND

If a building such as a factory or other such manufacturing facility or the like employs exhaust fans to eliminate smoke, odors, fumes or contaminated air, there is likely a need for a make-up air system. This is due to the fact that the air which is exhausted from an enclosure has to be replaced by air from somewhere else. When it isn't actively replaced a negative pressure is created within the enclosure. Negative pressure can create numerous ongoing problems within an enclosure or building which include without limitation excessive fuel costs, infiltration of dust and dirt, exhausters that do not operate efficiently, difficulty in opening and closing entrance and exit doors, back drafts through chimneys and vents, and employee discomfit which leads to absenteeism resulting from cold drafts and polluted air.

One known make-up air system is produced by Dynaforce Corporation of Old Bethpage, New York. Such a system and various modifications are shown in the Dynaforce catalog entitled Strato-Air 15620/DYN(-Buyline 1646) published in 1985. The system shown therein eliminates negative pressure and provides inherent heat recovery abilities that reduce the need to heat incoming make-up air although heating of make-up air remains as a possibility. Dynaforce Corporation produces a system employing a weather hood leading through an opening in an outside wall of a manufacturing facility or the like into a unit which provides a fan and perhaps air heating capabilities into a flexible polyethylene tube which effectively constitutes a collapsible and inflatable bag having venting openings through which air can be discharged. The polyethylene tube is fabricated of three-ply woven polyethylene which is very strong flexible material which is tear-resistant and meets the flame-retardant standards required by regulatory specifications. The chief function of this system is to avoid stratification with the warmer air being located at the top of the associated enclosure and with the cold air being located at the lower zone therein whereat are generally located the working personnel. The system does not provide for locating air flows towards specifically defined zones and as will be explained hereinafter this is one of the primary purposes of the instant invention.

As will also be shown in greater detail hereinbelow the instant invention provides for various nozzle arrangements and the like which are employed in conjunction with a conduit perforated with openings for the discharge of air. For this reason we have undertaken an examination of airflow controls and have found patents dealing with this subject including U.S. Pat. Nos. 583,501; 2,000,112; 2,523,933; 3,366,363; and 4,111,106.

In U.S. Pat. No. 583,501, J. McCreery discloses an outlet nozzle which is axially rotatable and is provided with a hood or cover made of several segments which are pivotally mounted to provide a hood of variable extent. This unit results in interstices which result in the accumulation of dirt and grime and its utilization in the manner set forth hereinbelow is not suggested.

H. Wheller discloses in U.S. Pat. No. 2,000,112 an arrangement of vanes in operative association with a heater to constitute a flow director or baffle or the like. Its association in a system as is set forth hereinbelow is likewise not suggested.

In U.S. Pat. No. 2,523,933 is revealed a pivotal air director which, diverts from a horizontal to an angularly postured arrangement. This system employs a linkage arrangement for varying the position of the air director and is not shown in affiliation with a system of the type with which the invention is employed.

In U.S. Pat. No. 3,366,363 is revealed a vent valve by C. Hogan et al. This disclosed device involves relatively rotatable members and suggests the use of a closable diaphragm in accordance with certain embodiments in this prior art patent. Use of this arrangement is suggested for personnel compartments of public transportation vehicles and is not suggested for the particular usages envisaged in accordance with the invention.

W. Burns reveals in U.S. Pat. No. 4,111,106 a ventilation system for automobiles and the like which have windows which can be adjusted. The assembly suggested in this patent includes an external scoop for forcing air into the automobile and an internal orientable nozzle for adjustably directing the forced air as desired. Special configurations are envisaged to adjust the system to compensate for vehicle speed and the like.

SUMMARY OF INVENTION

It is an object of the invention to provide an improved air distribution system.

It is another object of the invention to provide an improved system for the supply of make-up air in enclosures such as exist in manufacturing facilities, factories and the like.

It is yet another object of the invention to provide an improved air supply system capable of providing for the supply of make-up air and the like to specifically focused zones.

It is yet another object of the invention to provide improved air distribution systems capable of controlling air diffusion and air deflection according to requirements.

Yet another object of the invention is to provide an improved system susceptible of remote control adjustments in response to the sensing of conditions at particular zones within a particular enclosure.

In achieving the above and other of the objects of the invention there is contemplated the provision of an apparatus or system for use in a structure defining an enclosure, said apparatus including a source of intake air, an elongated conduit in this enclosure and coupled to the source to receive the air therefrom, said conduit being of a generally rigid material and extending through at least a part of. the enclosure at an upper location therein. The conduit is preferably provided with a plurality of openings allowing air to be discharged from the conduit via these openings into the enclosure. A control arrangement is provided in at least one of these openings to control the flow of air from the conduit into the enclosure.

According to various forms of the control provision is made to change the direction of flow of air upon the exiting of the air from the conduit or to control the diffusion of the air also upon the exiting of air from the conduit. An arrangement may also be provided to intercept at least part of the air within the conduit and to divert the same through the associated opening. At least one and preferably all of the aforesaid openings have axes which are radially disposed relative to the conduit with perhaps the exception of a terminal opening which is disposed axially relative to the conduit. The conduit furthermore is preferably horizontally disposed within the enclosure. The conduit may be provided in serially connected sections and these sections may be telescopically connected to one another.

According to a feature of the invention a remote control arrangement is provided to control the control arrangements associated with the conduit. Sensing devices may be provided for sensing temperature conditions at various positions in the enclosure for purposes of feeding a signal to the remote control to operate the same.

One type of control provided in accordance with the invention includes two plates which are coupled together in a controllably variable V-shaped relationship about an axis aligned transversely of the conduit, these plates being located in a flow of air from the associated conduit.

Another form of control envisaged in accordance with the invention is an elbow-shaped conduit rotatably mounted at one of the openings and having an axis of rotation coincident with the axis of the associated opening.

Still another form of control envisaged in accordance with the invention is the provision of a nozzle including two serially arranged sections and a pleated section connecting the serially arranged sections so that an angular adjustment can be made between the sections.

Another form of control provided in accordance with the invention includes a hood mounted on and internally of the conduit at one of the aforementioned openings to intercept part of the flow of air within the conduit and to divert the same through the associated opening.

In a preferred embodiment of the invention an airflow straightening arrangement may be provided within the conduit. The purpose of this straightening arrangement is to reduce eddy flow of the airflow within the conduit to facilitate discharge through the openings therein.

Another control envisaged in accordance with the invention is a V-shaped arrangement of plates connected along a ridge with a pivotal arrangement supporting the V-shaped arrangement for pivotal adjustment about an axis transverse to the ridge and to the conduit. The V-shaped arrangement is displaceable between first and second positions in one of which the plates are arranged along the flow of air through the conduit and in the other of which the plates are angularly disposed relative to the flow to deflect at least a part of the flow. An electro-mechanical device may be connected between the conduit and V-shaped arrangement to control a pivoting of the latter. A control signal will be supplied to the electro-mechanical arrangement to control a pivoting of the same.

In yet another control envisaged in accordance with the invention a rotatable nozzle is provided on the conduit to direct airflow therefrom and an electro-mechanical arrangement is provided to control the rotation of the nozzle. This electro-mechanical arrangement may include a gear train associated with the nozzle to rotate the same.

In accordance with the preferred embodiment of the invention plugs may be provided for various of the openings and the openings may be provided with different diameters corresponding to the positions thereof along the conduit.

The above and other objects, features and advantages of the invention will be apparent from the detailed description which follows hereinbelow as illustrated in the accompanying drawing.

BRIEF DESCRIPTION OF DRAWING

In the drawing:

FIG. 7(*a*) is a diagrammatic top view of some of the components shown in FIG. 7;

DETAILED DESCRIPTION

As indicated above make-up air systems are of prime importance in any building with exhaust requirements and with no positive method of replacing exhaust air. In general and as indicated above air is exhausted to remove fumes, smoke, odors and contaminated or otherwise undesirable air. This air should be replaced since lack of make-up air creates the problem of negative pressure having the disadvantages which have been noted hereinabove.

There are previously available systems which provide make-up air and work on conventional stratification principles so that layers of hot and cold air do not form at different heights. These systems, however, do not provide for directing air at highly focused zones although they do provide for air jets constituted by cold air intake with stratified warm air above a work area thereby providing for comfortable or relatively comfortable mixed air temperatures resulting from normally wasted heat.

Figure 1:
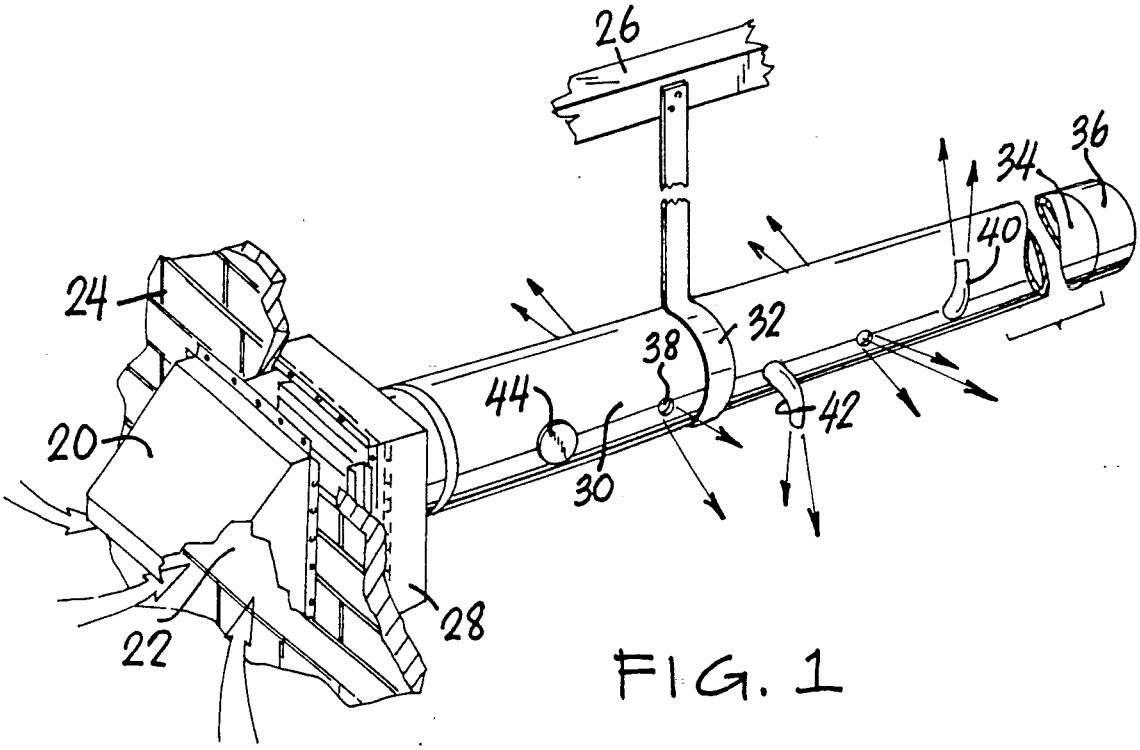
FIG. 1 illustrates in perspective and partially diagrammatic view the wall of a manufacturing facility from which extends a conduit provided for air distribution in accordance with the invention.

The system illustrated in FIG. 1 is provided in accordance with the invention. It employs some of the components which are known from the prior art such as a weather hood 20 covering an opening 22 provided in a wall 24 of a manufacturing facility or factory also having for example a roof 26. Also shared in common with known systems is a casing or unit 28 within which is located a fan (not shown) for purposes of directing intake air via conduit 30. Another feature which is known is the utilization of a heating apparatus as will be described in greater detail hereinbelow. This heating apparatus is employed to mix warm air with the colder intake air to provide a resulting airflow at a temperature according to specific requirements.

In the prior art stratification air make-up system the conduit 30 is replaced by a flexible bag or tube fabricated of woven polyethylene or the like and provided with perforations which permit the escape or discharge of air. In the illustrated embodiment of the invention the conduit 30 is made of a rigid material such as metal (steel is suitable) or a rigid plastic. The conduit may be suspended from the roof 26 or an equivalent ceiling by means of straps of which strap 32 is illustrative.

The conduit may be of any desired length terminating in a portion 34 on which may be fit an end cap 36. The end cap 36 may be provided for the discharge of air and this may be a supervised or controlled discharge of air as will be explained hereinbelow. The conduit 30 may also be provided with a plurality of openings 38 through which may be discharged high velocity air jets for passing the intake or make-up air into the enclosure for the reasons discussed above.

In accordance with the invention there may be provided for the discharge openings a number of nozzles or controls or the like as seen for example at 40 and 42. Indeed some of the openings may be simply plugged as indicated at 44. Further control devices will be later discussed hereinbelow in this text.

Figure 2:
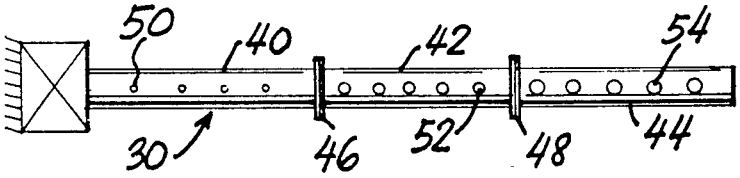
FIG. 2 illustrates diagrammatically an arrangement of conduit sections which may be employed in the system of FIG. 1.

FIG. 2 illustrates that the conduit 30 may be provided in the form of a plurality of serially connected sections 40,42 and 44. These sections may be connected by mating and bolted flange arrangements 46 and 48. The apertures provided in these sections are indicated for example at 50,52 and 54. The size of these apertures or openings may be varied for accommodation of the change in airflow head which takes place along the length of the conduit. Thus the openings or apertures 50 will be smallest, the apertures or openings 52 will be next smallest, and the apertures or openings 54 will be largest since the airflow head may be reduced gradually along the length of the aggregate conduit 30.

Figure 3:
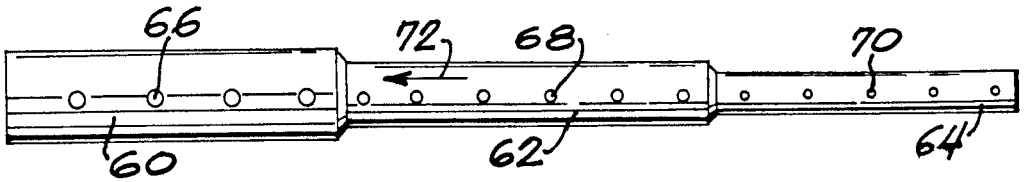
FIG. 3 illustrates a telescopic arrangement of conduit sections which may be employed in the system of FIG. 1.

In FIG. 3 are shown telescopically connected conduit sections 60,62 and 64. These conduit sections will be provided with various openings or apertures 66,68 and 70. In the illustration of FIG. 3 the airflow direction may be considered to take place according to the arrow 72. In this event the aperture 70 will be smallest, the aperture 68 will be next smallest, and the aperture 66 will be largest to accommodate the airflow and loss of airflow head as mentioned hereinabove.

Figure 4:
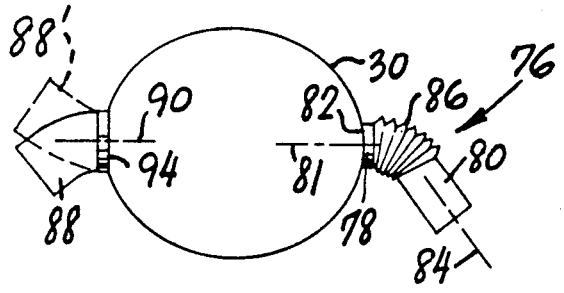
FIG. 4 illustrates diagrammatically two orientable nozzles envisaged for use in the apparatus of FIG. 1.

In accordance with the invention the apertures or openings may be provided with a variety of controls. Two such controls are illustrated in FIG. 4 in diagrammatic form wherein appear orientable nozzles. One such nozzle appears at 76 consisting of sections 78 and 80. Section 78 has an axis 80 coincident with the radially disposed axis of the corresponding opening 82. The axis of section 80 is indicated at 84 and is disposed at an angle relative to the axis 81. Sections 78 and 80 are connected by a section 86 which is pleated in the manner of an accordion fold. This enables the manual adjustment of the angle of section 80 relative to the section 78 according to the requirements of the particular installation. This means that the nozzle or section 80 may be directed to a particularly focused zone so that a cohesive air jet focused at a desired zone will result.

A second nozzle is indicated in FIG. 4 at 88. This nozzle also offers the possibilities of control by means of its rotatability about axis 90 by virtue of the rotatable connection 92. Thus, for example, nozzle 88 may be directed to the position indicated at 88'. This enables a certain limited control of the air jet issuing from the associated opening 94. Thus the air starts out being discharged in a radially outward direction and is thereafter diverted under the control of the position of nozzle 88. This arrangement also provides for a control such that the air jet is aimed at a particularly defined zone within the enclosure in the manufacturing facility as has been discussed hereinabove.

Figure 5:
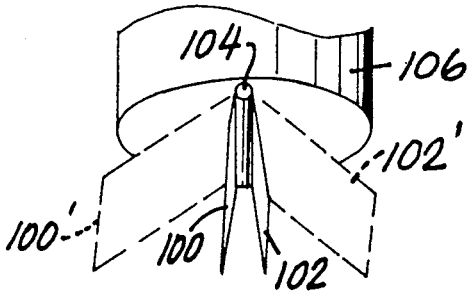
FIG. 5 illustrates a further control envisaged for use in the system of FIG. 1.

A type of control other than directional control is also offered in accordance with the invention. FIG. 5 illustrates an example of one such provision or feature. Therein two flat plates 100 and 102 are connected together at a hinge 104 whereat the plates 100 and 102 are pivotally supported for displacement for example to the positions indicated at 100' and 102'. The plates 100 and 102 are frictionally supported on the hinge 104 and may be manually adjustable although electro-mechanical controls of the form hereinafter disclosed may also be employed. The hinge 104 has its axis arranged transverse to the nozzle or outlet pipe indicated at 106. This nozzle may be a nozzle fit into an associated opening in the conduit 30 (not shown in FIG. 5). The section or nozzle 106 may also be the terminal section of the conduit 30 as illustrated at the end cap 36 in FIG. 1.

Figure 6:
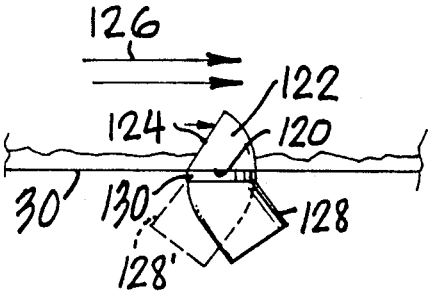
FIG. 6 illustrates yet another control envisaged for use in the system of FIG. 1.

Also contemplated within the scope of the invention is the arrangement illustrated in FIG. 6 wherein appears a section of the conduit 30 with an opening 120. Located internally of the conduit 30 is a hood 122 having an opening 124 therein. The hood 122 intercepts a portion of the airflow through the conduit as indicated at 126 and a portion of this flow is diverted radially outwards through the opening 120. In rotatable association with the hood 122 but mounted externally of the conduit 30 is a nozzle or conduit 128. This nozzle is mounted rotatably by coupling 130 on the outside of the conduit so as to be displaceable for example to the position indicated at 128'. Thus the intercepted and diverted airflow portion may be directed as desired by the associated and displaceable nozzle 128.

Figure 7A:
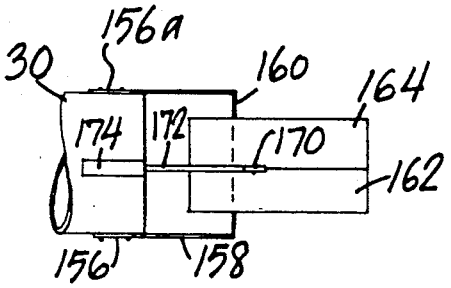
FIG. 7 illustrates still a further control envisaged for use in the system of FIG. 1; this control being susceptible of responding to remotely supplied signals.
Figure 7:
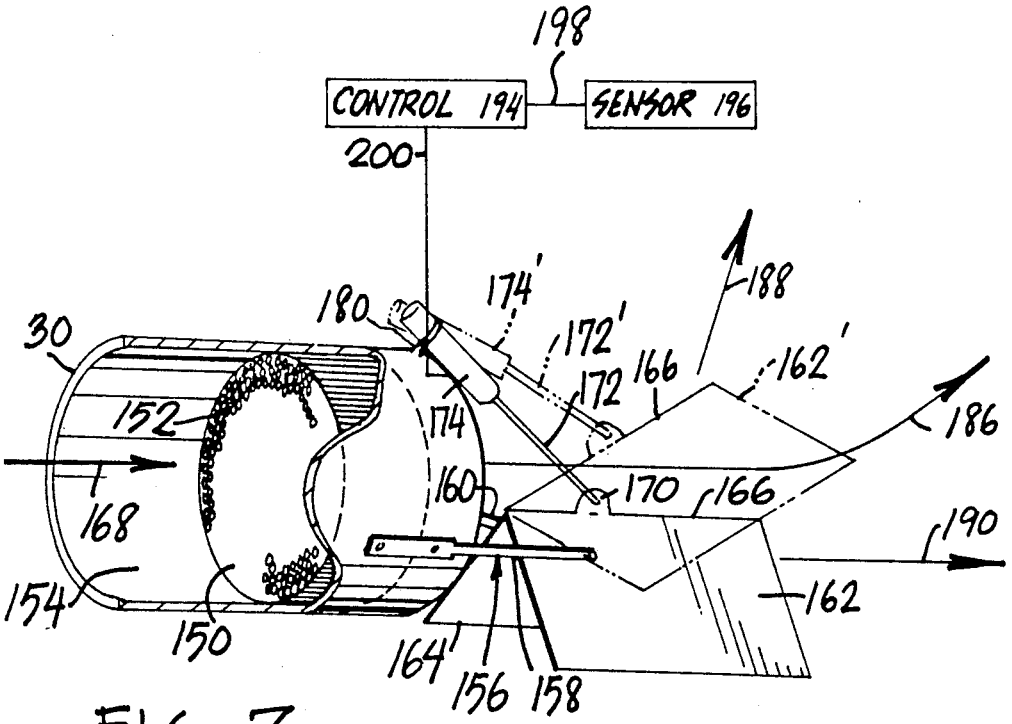

FIG. 7 illustrates a terminal portion of the conduit 30 or a nozzle associated with one of the openings provided in the conduit. By way of illustration of a further feature which may be incorporated into structures of the invention there is provided an air straightening device 150 which consists of a multitude of parallel tubes 152 arranged in honeycomb fashion in a circular or cylindrical assemblage which fills the internal bore 154 in the conduit 30. This bundle of tubes 152 provides for straightening the flow of air passing through the conduit and outwardly therefrom in order to avoid eddies and other irregular movements of the airflow which would interfere with the precise control thereof.

Mounted on the ends and outside surface of the conduit 30 is a support 156. This consists of two rods 158 (only one of which is shown) and a traversing rod 160 connected therebetween. The rod 160 is arranged transversely of the conduit 30. It serves as a pivot or hinge for an assembly of plates 162 and 164 which are connected together along a ridge 166 in a V-shaped assemblage. The ridge 166 in the illustrated position of plates 162 and 164 is along the airflow direction indicated by arrow 168. Atop the ridge 166 is mounted a pivot receptacle 170 which receives an end of rod 172. This rod is controlled by an electro-mechanical device 174 which may be a solenoid or the like susceptible of causing reciprocal movement of the rod 172 as illustrated by double-headed arrow 176. Upon withdrawal of the rod 176 plate 162 moves to the position indicated at 162' with rod 172 being displaced to the position shown by 172' and with electro-mechanical device 174 being removed to the position shown at 174'. This is all permitted by the pivotal support indicated at 180 whereby the V-shaped assemblage is tilted into intercepting relationship with at least a part of the airflow as indicated by arrows 186 and 188. Arrow 186 indicates the deflection of the airflow from plate 162 in position 162' with the ridge 166 being moved to position 166' and with plate 164 having been moved to a position to cause a deflection in the direction illustrated by arrow 188. A portion of the airflow moves undeflected under the V-shaped arrangement to give an undeflected airflow path indicated at 190.

To facilitate an understanding of the operation of the structure of FIG. 7 a diagrammatic top plan view is illustrated in FIG. 7(*a*). Therein appears conduit 30 with the support 158 being shown mounted at 156 and 156*a* with the conduit traversing pivot being illustrated at 160. Also appearing in this view are plates 162 and 164, a pivotal connection being indicated again at 170 for rod 172 which is connected to pivotally mounted electro-mechanical control 174.

Yet a further control for the arrangement of FIG. 7 appears at 194. This being a remote control sensitive to signals supplied by sensor 196 via line 198. The control 194 generates a control signal which is transmitted via line 200 to the electro-mechanical device 174 for the control thereof and for the displacement of the V-shaped deflection arrangement.

Figure 8:
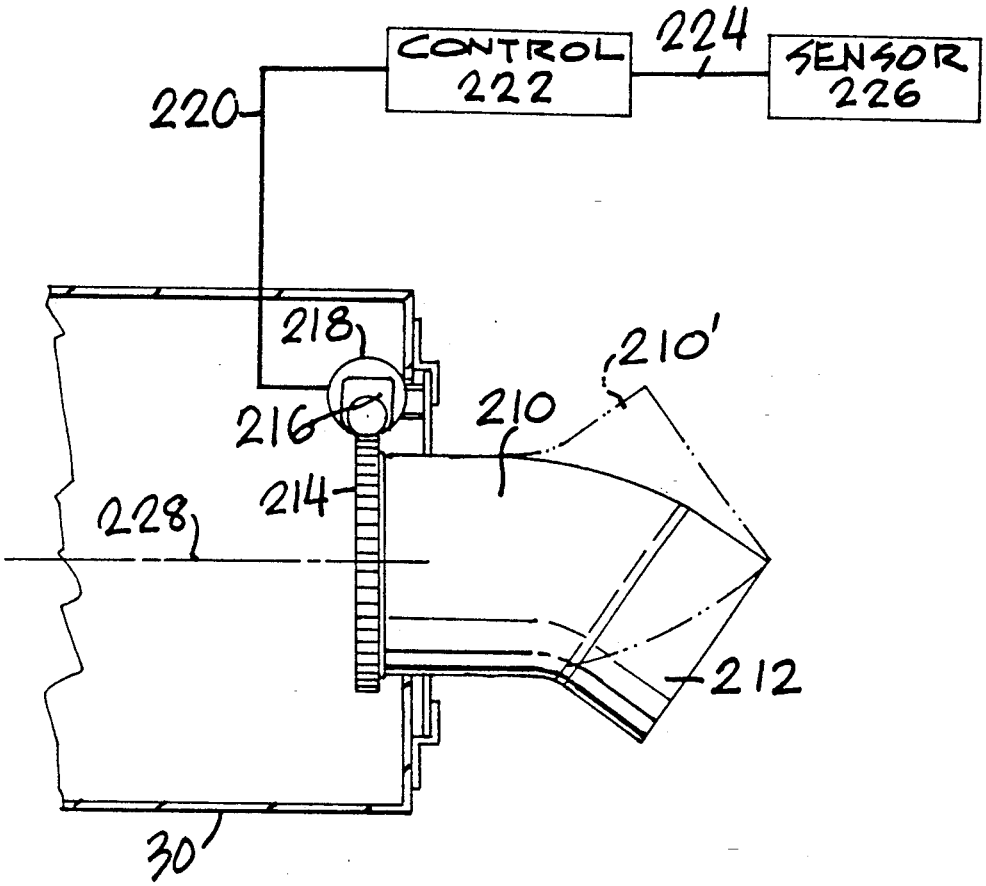
FIG. 8 reveals yet another control envisaged for use in the system of FIG. 1.

The arrangement shown in FIG. 7 is a diffusion control. In other words this arrangement controls the diffusion of the airflow which exits from the conduit 30 as a cohesive air jet flow. A control of direction only appears in FIG. 8 where appears the elbow-shaped nozzle 210 having an airflow straightened arrangement 212 mounted at the terminal end thereof. The airflow straightener is a bundle of relatively small tubes cemented together in honeycomb arrangement as has been described hereinabove relative to the air straightener arrangement 150 appearing in FIG. 7. Referring again to FIG. 8 it is seen therein that the elbow-shaped nozzle arrangement has affixed thereto a ring gear 214 which is in engagement with a worm gear 216 driven by a motor 218 under the control of a control signal received via line 220 and originating in remote control 222. The remote control 222 receives its activation signals from a line 224 connected to a sensor 226 which may be located in any focused or well-defined zone existing within the enclosure for which make-up air is being supplied.

The nozzle may rotate 360° about the axis indicated at 228 thereby for example to assume a position such as illustrated at 210'. Thus the direction of airflow from the conduit 30 can be controlled under the direction of the remote control 222 all as provided in accordance with the invention which provides for the control of direction and/or diffusion of the airflow exiting from the conduit through which air distribution is made.

Figure 9:
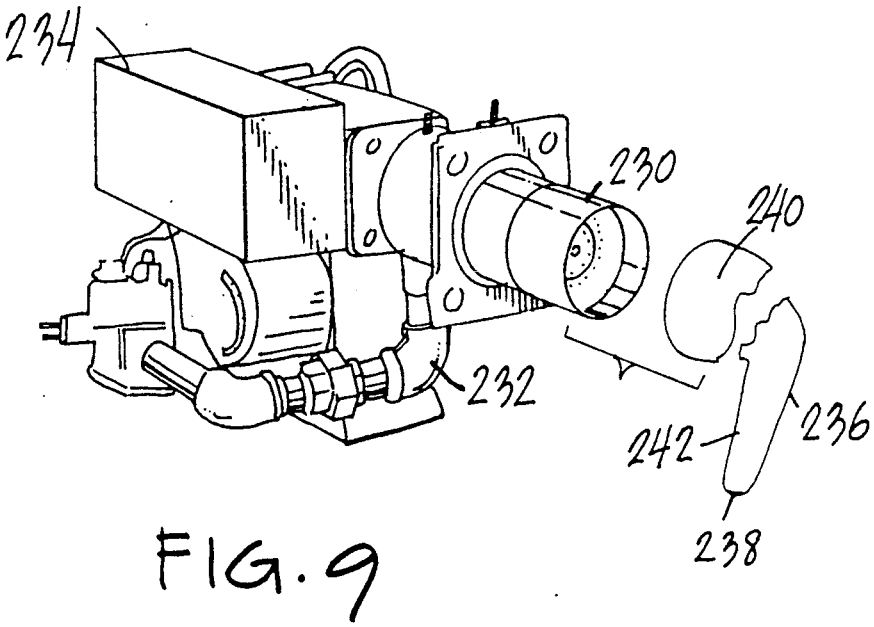
FIG. 9 reveals a commercially available heating system which is capable of being employed in the system of FIG. 1.

As mentioned hereinabove the supply of air may be heat-modulated. An example of a device suitable for this purpose is shown in FIG. 9. This device is a commercially available device supplied by the American Burner Corporation of Commack, New York in the form for example of Model OE-B which is capable of supplying 200,000 to 400,000 BTUs per hour by the utilization of a mixture of air and an ignitable gas, the ignition of which takes place in the ignition nozzle 230 which mixes gas supplied via pipe 232 with a supply of air under the control of a control unit 234. The unit is supplied with nozzle 236 at the terminus 238 of which issues a flame providing heated combustion products which mix with the air intake to heat the same. The nozzle 236 may have a section 240 connected to the air ignition nozzle or chamber 230, there being a second section 242 connected at right angles to the section 240 in order to provide a direction of flame issuance corresponding to the direction of airflow through the conduit 30. It will be appreciated that other forms of air heating treatment may be provided in substitution for that illustrated as the particular form of air heating does not form a limitation of the invention except for the fact that the issuance of a flame is preferably directed in the direction of airflow.

There will now be obvious to those skilled in the art many modifications and variations of the structures and arrangements set forth hereinabove. These modifications and variations will not depart from the scope of the invention if defined by the following claims.

What is claimed is:

1. Apparatus for use in a structure defining an enclosure, said apparatus comprising a source of air, an elongated conduit in said enclosure and coupled to said source to receive said air therefrom, said conduit being of a generally rigid material and extending through at least a part of said enclosure at an upper location in the enclosure, said conduit further being provided with a plurality of openings allowing air to be discharged from the conduit via said openings into the enclosure, and control means in at least one of said openings to control the flow of air from the conduit into said enclosure; said control means including a rotatable nozzle on said conduit to direct air flow from the conduit and electro-mechanical means to control the rotation of said nozzle.

2. Apparatus as claimed in claim 1 wherein said electro-mechanical means includes a gear train associated with said nozzle to rotate the same.

* * * * *